US009679729B2

(12) United States Patent
Connell

(10) Patent No.: US 9,679,729 B2
(45) Date of Patent: Jun. 13, 2017

(54) ELECTRICAL DISCONNECT CONTACTORS

(71) Applicant: Johnson Electric S.A., Murten (CH)

(72) Inventor: Richard Anthony Connell, Cambridge (GB)

(73) Assignee: JOHNSON ELECTRIC S.A., Murten (CH)

( * ) Notice: Subject to any disclaimer, the term of this patent is extended or adjusted under 35 U.S.C. 154(b) by 0 days.

(21) Appl. No.: 15/295,024

(22) Filed: Oct. 17, 2016

(65) Prior Publication Data

US 2017/0110277 A1 Apr. 20, 2017

(30) Foreign Application Priority Data

Oct. 16, 2015 (GB) ..... 1518356.9

(51) Int. Cl.
*H01H 71/04* (2006.01)
*H01H 51/00* (2006.01)

(52) U.S. Cl.
CPC ..... *H01H 51/00* (2013.01); *H01H 71/04* (2013.01); *H01H 2071/048* (2013.01)

(58) Field of Classification Search
CPC ..... H01H 51/00; H01H 53/04; H01H 71/04; H01H 2071/044; H01H 2071/048
See application file for complete search history.

(56) References Cited

U.S. PATENT DOCUMENTS 6,683,764 B1 * 1/2004 Pniok ..... H01H 9/44 361/12

* cited by examiner

*Primary Examiner* — Ramon M Barrera
(74) *Attorney, Agent, or Firm* — Muncy, Geissler, Olds & Lowe, P.C.

(57) ABSTRACT

A low-profile electrical contactor is provided comprising at least one electrical contact switch, an actuation means and a current determining device. The or each electrical contact switch has first and second electrical terminals, an electrically-conductive busbar in electrical communication with the first electrical terminal, the busbar having two end faces between which a current can flow in a flow direction and at least two flat sides in parallel with the flow direction, at least one fixed electrical contact which is attached to the busbar, an electrically-conductive moveable arm in electrical communication with the second electrical terminal, and at least one moveable electrical contact which is attached to the electrically-conductive moveable arm to form an electrical contact set with the fixed electrical contact. The actuation means can actuate the electrically-conductive moveable arm of the or each electrical contact switch between open and closed conditions. The current determining device has a first field-modifying element formed of a magnetic material located at or adjacent to the first end face of the busbar, a second field-modifying element formed of a magnetic material and located at or adjacent to the second end face of the busbar, at least one sensing coil at or adjacent to the busbar and the first and second field-modifying elements, and having a coil axis between planes of the first and second flat sides. An electromagnetic field induced by the current flowing in the busbar is modified by the first and second field-modifying elements to extend more or substantially more in parallel with the coil axis of the sensing coil.

20 Claims, 5 Drawing Sheets

ELECTRICAL DISCONNECT CONTACTORS

CROSS REFERENCE TO RELATED APPLICATIONS

This non-provisional patent application claims priority under 35 U.S.C. §119(a) from Patent Application 1518356.9 filed in Britain on Oct. 16, 2015.

FIELD OF THE INVENTION

The present invention relates to a low-profile or slimline electrical contactor, in particular but not necessarily exclusively for use with smart electrical disconnect meters. Furthermore, the invention relates to a method of reducing the depth of an electrical contactor.

In order to provide a high-current electrical disconnect contactor for use with domestic and commercial metering arrangements, it is necessary to provide a normal current-transformer so as to allow the current to be safely measured. However, such transformers are typically very bulky in their construction.

In order to incorporate such a transformer into an electrical contactor arrangement, the overall size of the electrical contactor must be increased significantly. This not only increases the general bulk of the electrical contactor, but also lengthens the pathways of electrical communication required. This in turn requires a greater mass of electrically-conductive material, typically copper, which can be very expensive.

Furthermore, reduction in the size of an electrical contactor can make it difficult to incorporate the various features of the electrical contact switches housed therein which would ordinarily limit or prevent contact bounce and/or electrical arcing. This can make it challenging for any such electrical contactor to remain compliant with electrical safety guidelines and regulations.

SUMMARY OF THE INVENTION

The present invention seeks to provide a solution to the above-mentioned problems by providing a slimline or low-profile electrical contactor for smart electrical disconnect metering purposes.

According to a first aspect of the invention, there is provided a low-profile electrical contactor comprising: at least one electrical contact switch having first and second electrical terminals, an electrically-conductive busbar in electrical communication with the first electrical terminal, the busbar having two end faces between which a current can flow in a flow direction and at least two flat sides in parallel with the flow direction, at least one fixed electrical contact which is in electrical communication the busbar, an electrically-conductive moveable arm in electrical communication with the second electrical terminal, and at least one moveable electrical contact which is in electrical communication with the electrically-conductive moveable arm to form an electrical contact set with the fixed electrical contact; an actuation means to actuate the electrically-conductive moveable arm of the or each electrical contact switch between open and closed conditions; and a current determining device associated with the busbar, the current determining device having a first field-modifying element formed of a magnetic material located at or adjacent to the first flat side of the busbar, a second field-modifying element formed of a magnetic material and located at or adjacent to the second flat side of the busbar, at least one sensing coil at or adjacent to the busbar and the first and second field-modifying elements, and having a coil axis between planes of the first and second flat sides; wherein an electromagnetic field induced by the current flowing in the busbar is modified by the first and second field-modifying elements to extend more or substantially more in parallel with the coil axis of the or each sensing coil, whereby an induced-EMF at the or each sensing coil has improved proportionality with the current flowing in the busbar.

The invention may also relate to a low-profile electrical contactor comprising: at least one electrical contact switch having first and second electrical terminals, an electrically-conductive primary conductor in electrical communication with the first electrical terminal, the primary conductor having two end faces between which a current can flow in a flow direction and at least two flat sides in parallel with the flow direction, at least one fixed electrical contact which is in electrical communication with the primary conductor, an electrically-conductive moveable arm in electrical communication with the second electrical terminal, and at least one moveable electrical contact which is in electrical communication with the electrically-conductive moveable arm to form an electrical contact set with the fixed electrical contact; an actuation means to actuate the electrically-conductive moveable arm of the or each electrical contact switch between open and closed conditions; and a current determining device associated with the primary conductor, the current determining device having a first field-modifying element formed of a magnetic material located at or adjacent to the first flat side of the primary conductor, a second field-modifying element formed of a magnetic material and located at or adjacent to the second flat side of the primary conductor, at least one sensing device at or adjacent to the primary conductor and the first and second field-modifying elements, and having a device axis between planes of the first and second flat sides; wherein an electromagnetic field induced by the current flowing in the primary conductor is modified by the first and second field-modifying elements to extend more or substantially more in parallel with the device axis of the or each sensing device, whereby an induced-EMF at the or each sensing device has improved proportionality with the current flowing in the primary conductor.

The use of magnetic induction in both the current detection device and the ferromagnetic elements allows for the reduction in size of the present contactor arrangement; the bulky transformers which would ordinarily be required in order to read a normal current can thus be dispensed with.

According to the second aspect of the invention, there is provided a method of reducing the depth of an electrical contactor, the method comprising the step of providing a low-profile electrical contactor, preferably in accordance with the first aspect of the invention, wherein a depth of the current determining device within a housing of the electrical contactor is less than that of the busbar of an electrical contact switch of the electrical contactor. Preferably, this may be achieved by collocating the current determining device and busbar within the electrical contactor.

BRIEF DESCRIPTION OF THE DRAWINGS

The invention will now be more particularly described, by way of example only, with reference to the accompanying drawings, in which.

DETAILED DESCRIPTION OF THE PREFERRED EMBODIMENTS

Figure 1:
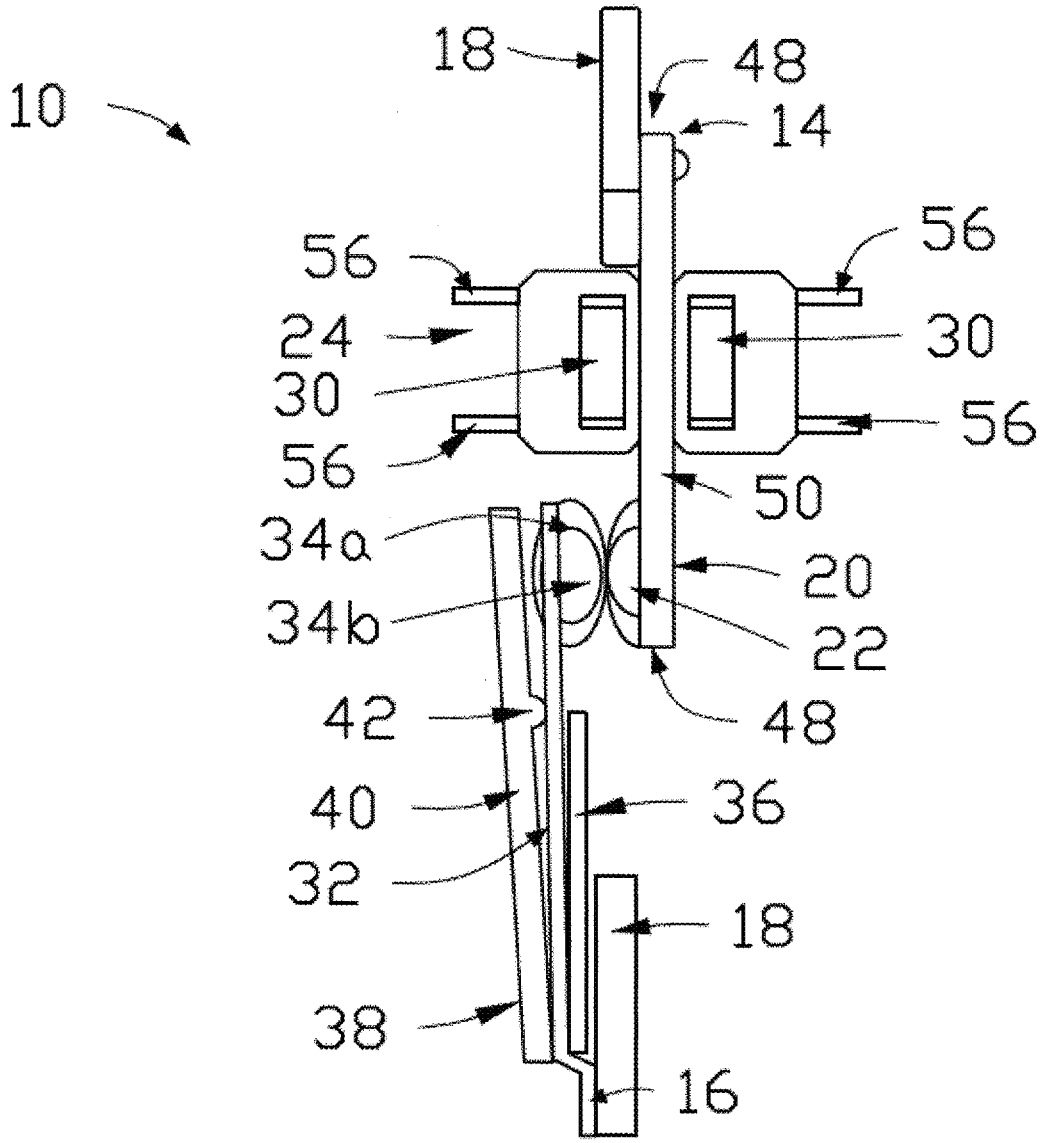
FIG. 1 shows a front representation of one embodiment of an electrical contact switch and current determining device for use in a low-profile electrical contactor in accordance with the first aspect of the invention.
Figure 2:
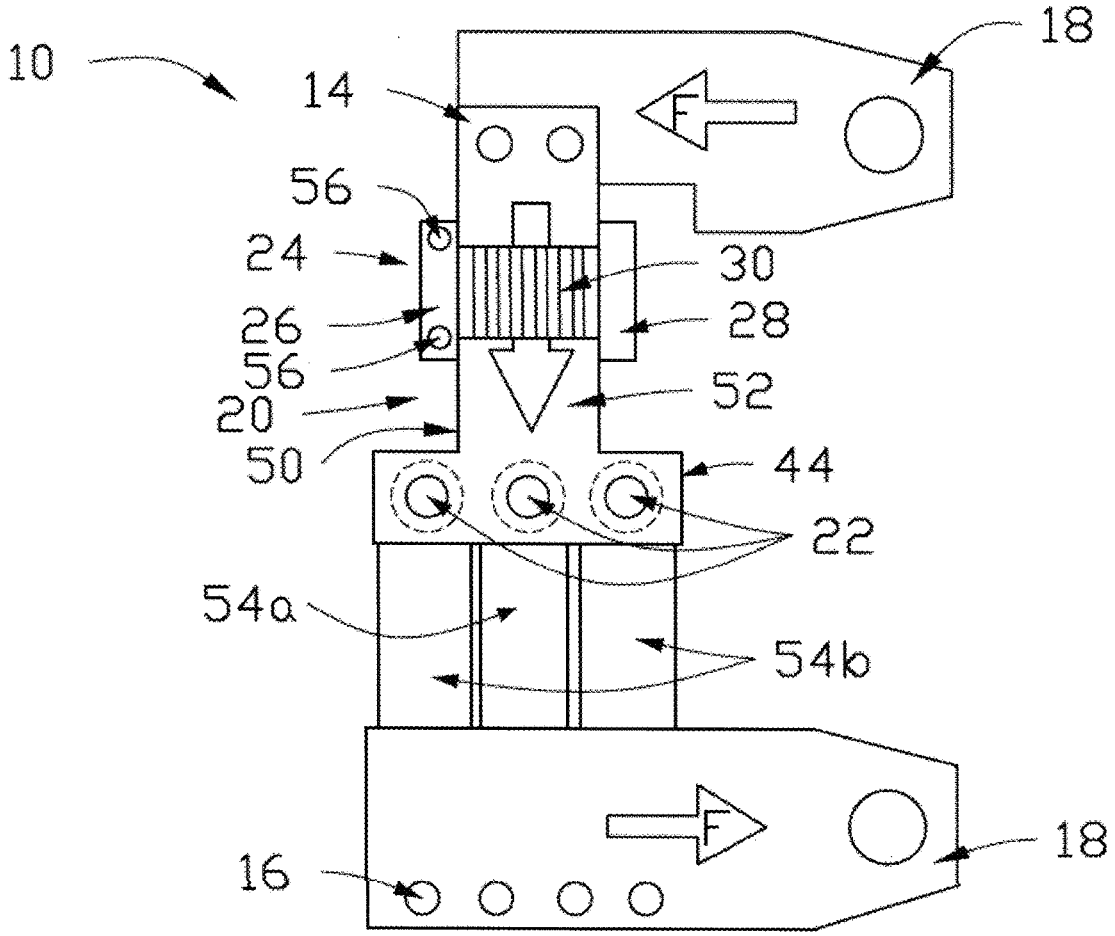
FIG. 2 shows a side representation of the electrical contact switch and current determining device of FIG. 1, with the green arrows indicating a direction of current flow.
Figure 3A:
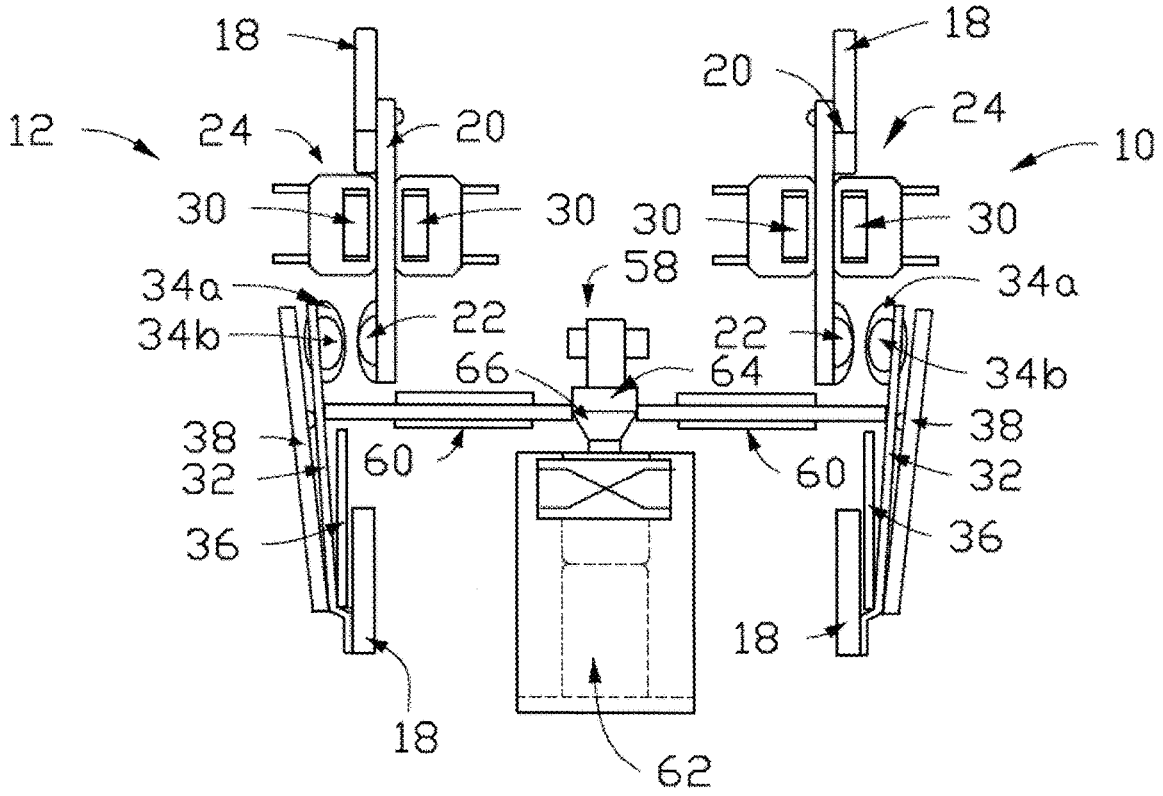
FIG. 3*a* shows a front representation of one embodiment of a low-profile electrical contactor in accordance with the first aspect of the invention, illustrating a contacts-open condition of the low-profile electrical contactor.
Figure 3B:
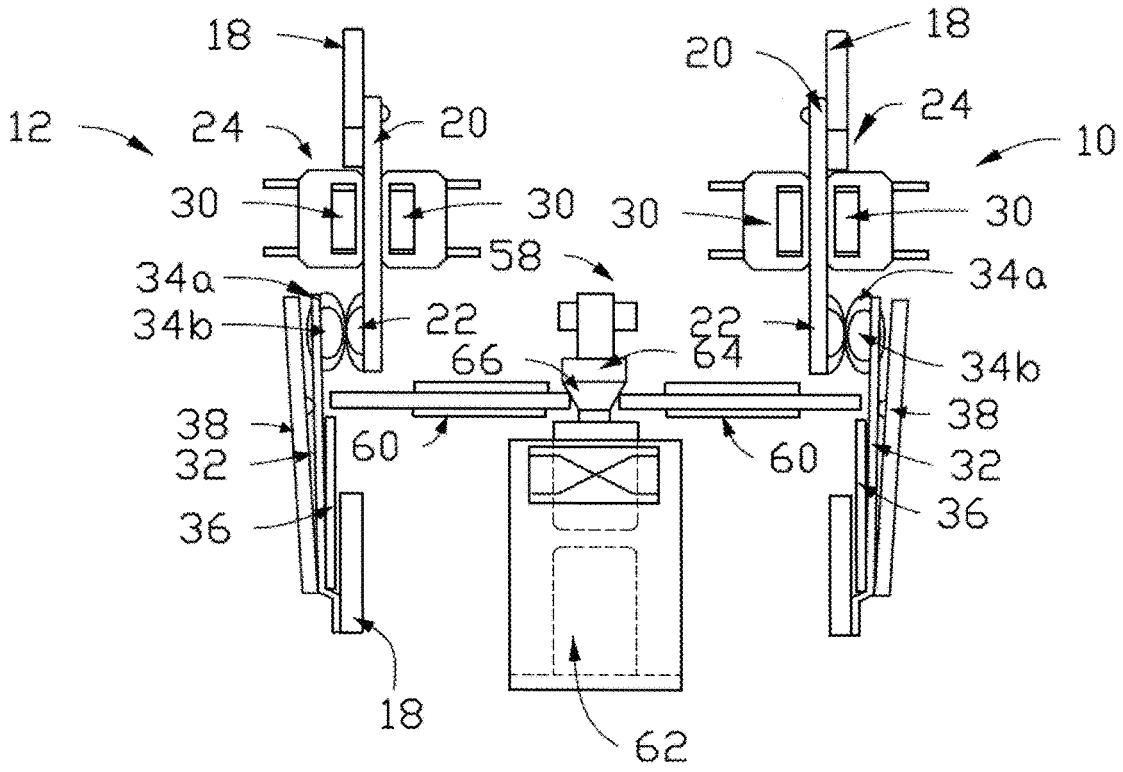
FIG. 3*b* shows a front representation of one embodiment of the electrical contactor of FIG. 3*a*, illustrating a contacts-closed condition of the low-profile electrical contactor.

Referring firstly to FIGS. 1 and 2, there is illustrated an electrical contact switch, indicated globally as 10 for use as part of a slimline or low-profile electrical contactor, such as that illustrated in FIGS. 3*a* and 3*b* at 12. The terms 'low-profile' and 'slimline' are intended to mean herein and throughout a reduction in front to back depth of the electrical contactor in relation to a traditional or standard known contactor.

The electrical contact switch 10 comprises first and second electrical terminals 14, 16, which, for simple installation into an electrical contactor 12, may be provided in connection with electrically-conductive stabs 18, as best illustrated in FIG. 2; an indicative direction of current flow is indicated by arrows F. In electrical communication with the first terminal 14 is a fixed electrically-conductive busbar 20, to which is attached at least one fixed electrical contact 22. Three such fixed contacts 22 are illustrated in the depicted embodiment, but it will be apparent that any known contact arrangement could readily be provided with the present invention, and the depicted contact arrangement is used by way of example only. Although a busbar 20 is suggested, any suitable current-carrying primary conductor may be utilised in the present invention.

Also affixed to the busbar 20 in the depicted embodiment is a current determining device 24, of which, the busbar 20 acts as a primary conductor thereof and is therefore rigid or at least stiff. The current determining device 24 also includes a first field-modifying element 26, a second field-modifying element 28, and at least one, and preferably two, as indicated, sensing coils 30.

There is, provided in electrical communication with the second terminal 16, an electrically-conductive moveable arm 32, to which is mounted at least one moveable electrical contact 34*a*, 34*b*. The moveable electrical contacts 34*a*, 34*b* are provided to form a complementary contact set with the fixed electrical contacts 22. In the present embodiment, the moveable electrical contacts are provided as one lead moveable electrical contact 34*a* and two lag electrical contacts 34*b*.

There is also provided a fixed ferromagnetic element, which is here provided as a fixed steel plate 36, at or adjacent to one side of the electrically-conductive moveable arm 32 which is proximate the second electrical terminal 16. In the depicted embodiment, the fixed steel plate 36 is riveted to the second electrical terminal 16, with the electrically-conductive moveable arm 32 being riveted to the second electrical terminal 16 so as to be positioned at an acute angle to the fixed steel plate 36. This positions the fixed steel plate 36 between the second terminal 16 and the electrically-conductive moveable arm 32, though the exact positioning of the fixed steel plate 36 could be amended slightly; for instance, the fixed steel plate 36 and second terminal 16 could be completely coplanar, by welding the two together.

On the opposite side of the electrically-conductive moveable arm 32 is positioned a moveable ferromagnetic element, here provided as a moveable steel plate 38 having a main plate body 40 and, preferably, a ridge, bump, protrusion or similar plate projection 42 extending from the main plate body 40 towards the electrically-conductive moveable arm 32. The moveable steel plate 38 is affixed to the second electrical terminal 16 and/or the electrically-conductive moveable arm 32 such that the main plate body 40 is at an acute angle to the electrically-conductive moveable arm 32, but such that the plate projection 42 is in physical contact with the electrically-conductive moveable arm 32.

Whilst the fixed and moveable steel plates 36, 38 are here presented as being formed from steel, the important feature of these elements is that a magnetic field can be induced therein. As such, any appropriate ferromagnetic material could be used, typically a soft ferromagnetic material such as iron, steel, cobalt, nickel or alloys thereof; soft here referring to the degree of ferromagnetism, rather than the hardness.

The busbar 20 is, in the depicted embodiment, formed so as to have a preferably T-shaped profile, with the fixed electrical contacts 22 being provided on the bridge 44 of the T-shape. This minimises the material requirements of the busbar 20 whilst maximising the available space for the contacts 22. Typically, the busbar 20 will be formed from an electrically conductive material such as brass, or perhaps copper, and the stabs 18 will be formed from a highly electrically-conductive material such as copper. Alternative materials, typically being metal, available for the construction of these components will be apparent to the skilled person, however.

The stem 46 of the T-shaped busbar 20 preferably has a length having a first dimension which begins and ends at end portion 48, a width having a second dimension, and a height having a third dimension. The width and height are preferably mutually perpendicular to each other as well as to the length, with the first dimension being greater than the second and third dimensions, and the second dimension being less than the third dimension. This consequently allows the stem 46 of the busbar 20 to define a rectangular or substantially rectangular cross-section laterally to and along a portion, preferably being at least a major portion, of the longitudinal extent.

Although preferably rectangular or substantially rectangular, the stem 46 of the busbar 20 may be of another polygonal or substantially polygonal lateral cross-section. However, a rectangular or substantially rectangular lateral cross-section is most beneficial due to the provision of opposing, preferably flat or planar, minor-sides 50 extending between the two opposing end portions 48 or at least along a portion of the longitudinal extent. The flat minor-sides 50 define the aforementioned width, in this case.

A further benefit of the rectangular or substantially rectangular lateral cross-section is the provision of the opposing, preferably flat or planar, major-sides 52 extending between the two opposing end faces 48 or at least along a portion of the longitudinal extent, and preferably perpendicularly to the flat minor-sides 50. The flat major-sides 52 define the aforementioned height, in this case.

The electrically-conductive moveable arm 32 is preferably formed as a split-blade aim, having one lead blade 54*a* and two lag blades 54*b*, to which the lead and lag moveable electrical contacts 34*a*, 34*b* are mounted. Typically, the electrically-conductive moveable arm 32 will be formed from a relatively thin electrically-conductive material having a degree of flexion therein. Commonly, this would be a thin plate of copper. In the absence of external forces, the mounting of the electrically-conductive moveable arm 32 means that the flexion naturally urges the moveable electrical contacts 34*a*, 34*b* towards the fixed electrical contacts 22. As such, the electrical contact switch 10 is naturally biased towards a closed condition.

The first and second field-modifying elements 26, 28 of the current determining device 24 may conveniently be formed of magnetic material, and in this case are preferably rigid or stiff planar or substantially planar plates. The plates in this case formed from a magnetisable material, that is, a soft magnetic material such as iron, cobalt, nickel or steel. Equally, though, the plates may be formed from a hard magnetic material, such as a permanent magnet, for instance a rare-earth magnet such as neodymium iron boron or samarium cobalt.

Although continuous or unbroken planar plates 26, 28 are suggested, in this case being preferably rectangular, it may be feasible to utilise non-planar plates or to have at least a portion which is non-planar, which may allow for further modification of the induced-electromagnetic field when a current flows in the busbar 20.

Additionally or alternatively, the plates may be discontinuous or have openings, as may be required. Again, it may become apparent that this again allows for further tuning of the generated electromagnetic field.

To preferably support the first and second field-modifying elements 26, 28 at or adjacent to the flat minor-sides 50 of the stem 46 of the busbar 20, the two sensing coils 30 are provided, in this case preferably clipped in spaced relationship to the busbar 20. The sensing coils 30 may be provided with a bobbin former around which electrically conductive wire is coiled multiple times so as to be tightly packed, typically with a plurality of overlying turns or runs.

At each end of the former may be provided a, preferably elongate, holder for receiving ends or sides of the first and second field-modifying elements 26, 28. Generally, the holder may conveniently include a recess within the body of the holder. The recess may be slot-shaped, and sufficiently dimensioned to receive a portion of one of first and second field-modifying elements 26, 28 as a complementarily fit. The dimensions of the recess may allow for a tolerance or close fit of the respective first and second field-modifying element 26, 28.

With the first and second field-modifying elements 26, 28 engaged with respective ends of the first and second sensing coils 30, the coils 30 are then physically or mechanically connected directly to the stem 46 of the busbar 20 via their hangers, which as mentioned above may beneficially be in the form of clips or brackets. It is preferable that a width of the or each of the first and second field-modifying elements 26, 28 is greaten than a width of the flat minor-sides 50 to which they are at or adjacent; the overhang of each of the first and second field-modifying elements 26, 28 can allow for a greater uniformity of the magnetic field generated by the busbar 20, allowing for the magnetic field lines to be more parallel or substantially more parallel.

The clips or brackets are in the form of elongate rigid or semi-rigid arms, preferably cantilevered from the formers to project towards an opposing sensing coil 30. The arms are offset from each other, and are located over the minor-sides 50 to hold the sensing coils 30 in spaced relationship with their respective major-sides 52.

Although an air gap is present between the sensing coils 30 and the major-sides 52 of the stem 46 of the busbar 20, the sensing coils may be mounted directly to their respective major-sides. In this case, it is preferable that an electrically insulated layer or member is provided to electrically isolate each sensing device from the primary conductor to prevent or inhibit direct current flow thereto.

The hangers are beneficial in that the sensing coils 30 may thus be demountable from the busbar 20. However, a permanent fastening may be considered, as necessity dictates, and which may for example, take the form of a bracket which is permanently attached to the busbar 20, such as by welding, bonding or via one or more screw-threaded fasteners.

Although two sensing coils 30 are preferred to provide improved resolution, only one sensing coil or other suitable sensing device or means may be utilised.

Each sensing coil 30 has a width which is greater than its depth. A length of the sensing coil 30, and therefore the respective coil axes, also extends to or substantially to planes of the minor-sides 50. A lateral extent of each sensing coil 30 is thus preferably polygonal or substantially polygonal, and more preferably rectangular or substantially rectangular, in this case uniformly or substantially uniformly along at least a majority of the coil length.

From each coil end, a secondary conductor 56 extends thereby allowing a voltage signal to be monitored based on an induced electromotive force, also referenced herein and throughout as 'EMF'.

Although it has been suggested that a lateral cross-section of the busbar 20 is rectangular or substantially rectangular, provided the minor-sides are utilised, it may be feasible that the major-sides are arcuate or partially arcuate, if required.

The low-profile electrical contactor 12 is shown in a contacts-open condition in FIG. 3*a*, shown as a two-pole electrical contactor 12, having two electrical contact switches 10 as previously described. The electrical contactor 12 includes an actuation means, which is here illustrated as an electromagnetic actuator 58, having two switch arm engagement elements, formed here as sliding lifters 60.

The actuator 58 is formed having a solenoid 62 with a moveable plunger 64. The plunger 64 has a shaped cam surface 66 which is in contact with the sliding lifters 60. In the open configuration of FIG. 3*a*, the solenoid 62 is energised, and the plunger 64 is in a retracted condition. When in the retracted condition, the cam surface 66 is at its widest, meaning that the sliding lifters 60 are pushed into their extended condition relative to the electrically-conductive moveable arms 32 of the electrical contact switches 10.

In this contacts-open condition, the two electrical contact switches 10 are open, and thus no current passes through the electrical contact sets. No current will therefore be measured by the current determining devices 24, and any device which is dependent upon the closure of the electrical contact switches 10 will be non-operational.

It is then in the closure of the electrical contact sets which allows the present arrangement to illustrate its advantages over prior electrical contact switches. When the solenoid 62 is de-energised, the plunger 64 is expelled, and the sliding lifters 60 are allowed to retract inwardly. As the sliding lifters 60 retract the lead blade 54*a* on the electrically-conductive moveable arm 32 will move ahead of the lag blades 54*b*, such that contact is made between the lead moveable electrical contact 34*a* and fixed electrical contact 22 before contact is made between the lag moveable electrical contacts 34*b* and their corresponding fixed electrical contacts 22. This advantageously limits the propensity of the contacts 22, 34*a*, 34*b* to arc or spark as they come into proximity with one another, which would otherwise have deleterious effects on the life expectancy of such contact sets.

A lead-lag blade arrangement beneficially allows for the initial current-carrying at contact closure to be conducted solely by the lead blade 54*a*. A relatively large lead contact set 34*a*, 22 can be provided in order to avoid tack welding as a result. Once the lead blade 54*a* has made the connection, however, the risk of tack welding is minimised, and therefore the contact size, and therefore precious metal requirements, for the lag blades 54*b* is substantially reduced. The split-blade arrangement then beneficially allows for current-sharing across the three blades, minimising the potential for electrical arcing, which is proportional to the carried current.

The applied current will result in an instant magnetic field to be generated around the electrically-conductive moveable arm 32 of each electrical contact switch 10. This induces a magnetic field in each of the fixed and moveable steel plates 36, 38, the polarization of the respective magnetic fields being attractive to one another.

Since the fixed steel plate 36 is physically prevented from moving, the moveable steel plate 38 will be urged towards the fixed steel plate 36 as a result of this magnetic attraction. As the moveable steel plate 38 is cantilevered about a pivot point where it is connected to the electrically-conductive moveable arm 32 and/or second terminal 16, the force of the attraction is exerted at a distal, free end of the moveable steel plate 32. This free end 44 is closest to the moveable electrical contacts 34*a*, 34*b*, and therefore the urging of the moveable steel plate 38 results in a greater closure force being applied to the electrically-conductive moveable arm 32 through the plate projection 42 and therefore results in a more secure contact between the moveable and fixed contacts 34*a*, 34*b*, 22 of the contact set. Beneficially, this limits the likelihood of contact bounce, resulting in a more secure and accurately reproducible contact closure.

The positioning of the plate projection 42 on the plate body 40 is such that it is at a position of greatest magnetic interaction between the fixed and moveable steel plates 36, 38. In the depicted embodiment, this is somewhere between 60 and 70% of the length of the plate body 40, near to a point at which a free end of the fixed steel plate 36 corresponds vertically with the moveable steel plate 38.

Because the ferromagnetic plates 36, 38 can be placed in-line with the moveable arm 32, the depth of the fully-assembled electrical contactor 12 can be reduced; ordinarily, there would be a greater propensity for the moveable arm 32 to bounce upon closure with a slimline contact arrangement. However, the provision of the additional closure force provided by the ferromagnetic plates 36, 38 ensures that the likelihood of electrical arcing is kept to a minimum.

Furthermore, with a current F flowing through the busbar 20, thereby defining a flow direction such as that indicated by the arrows of FIG. 2, an electromagnetic field induced by the current in the busbar 20 is modified by the first and second field-modifying elements 26, 28. This electromagnetic field is manipulated or re-shaped to extend more in parallel or substantially in parallel with the coil axes of the sensing coils 30.

With the sensing coils 30 mechanically connected to the stem 46 of the busbar 20, an induced electromotive force is realised, thereby allowing a voltage signal to be outputted. The induced electromotive force and thus the associated monitored voltage have improved proportionality with the current flowing in the busbar 20, due to the combination of the rectangular or substantially rectangular lateral cross-section of the stem 46 of the busbar 20 and the first and second field-modifying elements 26, 28 manipulating the produced field to, as mentioned above, extend more in parallel or substantially in parallel with the coil axes of the sensing coils 30. An improved resolution or accuracy of the monitored voltage being proportional to the current flowing in the busbar 20, and therefore in the electrical contactor 12 is thus achieved.

As a consequence of this, to maintain a current or presently monitored voltage resolution or accuracy, which may in fact be sufficient or adequate for the present application, the sensing coils 30 can actually be reduced in volume or size. This thereby enables not only material and manufacturing time and cost-saving during the production of the sensing coils 30, but also the busbar 20 may also be reduced in size with similar benefits being achieved. This can advantageously therefore reduce the bulk and manufacturing cost of the low-profile electrical contactor 12.

A corrector circuit may also be utilised in combination with the current determining device 24 described above, associated with the electrical contactor 12. This would be beneficial due to the output signal in the secondary conductors 56 being 90 degrees lagging and thus out of phase with the current to be measured or monitored in the busbar 20.

To this end, the corrector circuit may preferably include a signal input for receiving an output signal from the sensing coils 30 corresponding to an induced voltage, a differential-phase correction integrator circuit having a first operational amplifier, also called an op-amp, and a scaling calibration circuit having a second operational amplifier.

Figure 4:
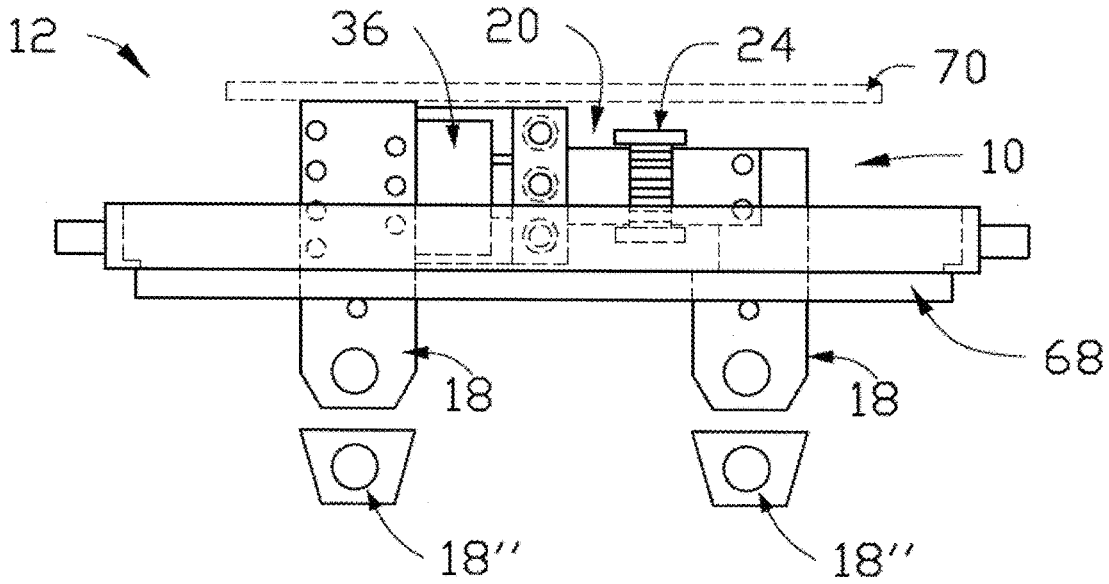
FIG. 4 shows a side representation of the low-profile electrical contactor of FIGS. 3*a* and 3*b*, indicating a position of the meter casing of the electrical contactor, indicating the normal position of the terminal stabs for an ordinary electrical contactor.

The various features of the electrical contactor 12 serve to both reduce the cost of manufacturing the contactor 12 by reducing the volume of electrically-conductive material required in the device, but also to reduce the overall depth of the electrical contactor 12. FIG. 4 illustrates this advantage in detail, showing a side view of the electrical contactor 12.

Here, the low-profile electrical contactor 12 is illustrated including an integrated contactor base 68 which may form part of an electrical disconnect meter with which the electrical contactor 12 is intended to be used. This integrated contactor base 68 may be formed from a moulded plastics material, or a similarly electrically-insulative material, and is framed so as to permit the stabs 18 of the electrical contact switches 10 to protrude therethrough.

The contactor base 68 is designed to be incorporated directly into an electrical disconnect meter, and therefore, rather than requiring the stabs 18 to project through a standard contactor housing and a front face of a meter housing, the integrated contactor base 68 acts as both of these housings simultaneously. This allows the length of the stabs 18 to be significantly reduced; the traditional length of stabs is indicated in FIG. 4 as 18". This results in a significant reduction in the copper or similarly electrically-conductive material required to form the stabs 18.

Furthermore, the busbar 20 and current determining device 24 of the electrical contactor 12 are formed so as to be collocated with one another; this is achieved by making the depth of the current determining device 24 to be less than or equal to a depth of the busbar 20, in particular so as to be less than the depth of the bridge 44 of the busbar 20. In use, therefore, the current determining device 24 does not add any additional bulk to the electrical contactor 12.

In reducing the size of the current determining device 24 and positioning it in a convenient position within the electrical contactor 12, the overall size of the electrical contactor 12 can be reduced, as illustrated by the indicative contactor housing indicated generally at 70 in FIG. 4.

Although it is suggested that the field-modifying elements are held in spaced relationship with the minor or narrower flat sides of the primary conductor, they may feasibly be mounted directly to the flat sides, for example, by utilising an electrically isolating layer interposed therebetween. Furthermore, although it is suggested that the field-modifying elements are positioned at or adjacent to the minor flat-sides, and the sensing device is position adjacent to one or more of the major flat-sides, this may feasibly be reversed, dependent on necessity.

The sensing means, which in this case is one or more coils, preferably provides a non-circular lateral cross-section along the axis of the former or bobbin. However, other cross-sectional winding shapes are feasible, such as circular. However, a benefit of the elongate wound cross-section is that an increased activated area or volume of the sensing means is achieved.

Whilst this illustrated embodiment of the electrical contactor is shown having two electrical contact switches, each with a single moveable arm in a nominally vertical arrangement, it will be appreciated that a bi-armed arrangement could be provided. However, the present arrangement is advantageous in that the single moveable arm represents a significant reduction in the amount of copper required in order to fabricate the switch.

Furthermore, although the current determining device is described as utilising sensing coils, it will be appreciated that any appropriate current sensing device could be used instead, provided a suitable interaction between the busbar and the sensing device can be arranged.

It is therefore possible to provide an electrical contactor which has a significantly reduced profile, whilst also significantly reducing the materials costs involved in the production of the contactor. This can be achieved by integrating a current determining device into the contactor, whilst providing a slimline electrical contact switch arrangement, which can limit contact bounce readily, thereby overcoming some of the traditional obstacles associated with slimline disconnect switches.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. A low-profile electrical contactor comprising:

at least one electrical contact switch having first and second electrical terminals, an electrically-conductive busbar in electrical communication with the first electrical terminal, the busbar having two end faces between which a current can flow in a flow direction and at least two flat sides in parallel with the flow direction, at least one fixed electrical contact which is in electrical communication with the busbar, an electrically-conductive moveable aim in electrical communication with the second electrical terminal, and at least one moveable electrical contact which is in electrical communication with the electrically-conductive moveable arm to form an electrical contact set with the fixed electrical contact;

an actuation means to actuate the electrically-conductive moveable arm of the or each electrical contact switch between open and closed conditions; and a current determining device associated with the busbar, the current determining device having a first field-modifying element formed of a magnetic material located at or adjacent to the first flat side of the busbar, a second field-modifying element formed of a magnetic material and located at or adjacent to the second flat side of the busbar, at least one sensing coil at or adjacent to the busbar and the first and second field-modifying elements, and having a coil axis between planes of the first and second flat sides;

wherein an electromagnetic field induced by the current flowing in the busbar is modified by the first and second field-modifying elements to extend more or substantially more in parallel with the coil axis of the or each sensing coil, whereby an induced-EMF at the or each sensing coil has improved proportionality with the current flowing in the busbar.

2. A low-profile electrical contactor as claimed in claim 1, wherein the or each electrical contact switch further comprises: a fixed ferromagnetic element positioned at or adjacent to a side of the electrically-conductive moveable atm proximate the second electrical terminal; and a moveable ferromagnetic element in physical communication with a side of the electrically-conductive moveable arm which is opposite to the fixed ferromagnetic element; and wherein, in a closed condition of the electrical contact set, the electrically-conductive moveable arm induces a magnetic field in the fixed and moveable ferromagnetic elements, the moveable ferromagnetic element being magnetically attracted towards the fixed ferromagnetic element to thereby increase a contact pressure on the electrical contact set.

3. A low-profile electrical contactor as claimed in claim 2, wherein the moveable ferromagnetic element includes a projection facing the electrically-conductive moveable arm to effect physical contact therebetween.

4. A low-profile electrical contactor as claimed in claim 3, wherein the projection is positioned at or adjacent to a point on the moveable ferromagnetic element of maximum attraction to the fixed ferromagnetic element in the said closed condition of the electrical contact set.

5. A low-profile electrical contactor as claimed in claim 2, wherein the moveable ferromagnetic element and/or fixed ferromagnetic element are formed as a steel plate, the electrically-conductive moveable arm is positioned at an acute angle to the fixed ferromagnetic element, and the electrically-conductive moveable arm is positioned at an acute angle to a main body portion of the moveable ferromagnetic element.

6. A low-profile electrical contactor as claimed in claim 1, wherein the electrically-conductive moveable arm has a split-blade arrangement, having at least two blades, each blade having one said moveable electrical contact thereon, the bulbar having a corresponding plurality of fixed electrical contacts thereon, at least one of the said blades of the electrically-conductive moveable arm is a lead blade and at least one of the said blades of the electrically-conductive moveable arm is a lag blade, wherein the or each lead blade is adapted such that the moveable electrical contact associated therewith makes contact with the corresponding fixed electrical contact before the moveable electrical contact associated with the or each lag blade.

7. A low-profile electrical contactor as claimed in claim 1, wherein the actuation means includes a switch-arm engagement element associated with the electrically-conductive moveable arm of the or each electrical contact switch, and an electromagnetically operable actuator to actuate the or each switch-arm engagement element, and the or each switch-arm engagement element has a shaped engagement surface to impart a lead-lag opening and closing actuation onto the or each electrically-conductive moveable arm.

8. A low-profile electrical contactor as claimed in claim 7, wherein the or each switch-arm engagement element is a sliding lifter having a plurality of engagement protrusions of different depth to form the shaped engagement surface.

9. A low-profile electrical contactor as claimed in claim 1, wherein the busbar has a polygonal or substantially polygonal cross-section lateral to the flow direction of at least the sensing coil.

10. A low-profile electrical contactor as claimed in claim 1, wherein the first and second field-modifying elements are plates, the first and second field-modifying elements comprise a magnetisable material or a permanent magnetic material, wherein the permanent magnetic material is a rate-earth magnetic material.

11. A low-profile electrical contactor as claimed in claim 1, wherein the first and second field-modifying elements are spaced from the busbar, and the first and second field-modifying elements are wider than the first and second flat sides of the busbar respectively.

12. A low-profile electrical contactor as claimed in claim 1, wherein first and second said sensing coils are provided at or adjacent to the busbar and the first and second field-modifying elements, each of the first and second sensing coils having a coil axis which extends between planes of the two end faces, the first and second sensing coils are positioned on opposite sides of the busbar, and the first and second sensing coils face each other.

13. A low-profile electrical contactor as claimed in claim 1, wherein the at least one sensing coil has a polygonal or substantially polygonal cross-section lateral to the coil axis.

14. A low-profile electrical contactor as claimed in claim 1; wherein the at least one sensing coil includes a hanger by which the or each sensing coil is engagable with the busbar.

15. A low-profile electrical contactor as claimed in claim 1, wherein the at least one sensing coil includes a holder for holding the first and second field-modifying elements in a spaced relationship with the busbar, and the holder is a recess at least end of the or each sensing coil in which a respective end of the first and second field-modifying elements is receivable.

16. A low-profile electrical contactor as claimed in claim 1, further comprising a corrector circuit for use in combination with the current determining device, the corrector circuit having an input for receiving an output signal corresponding to an induced-EMF from the or each sensing coil, and a differential-phase correction integrator circuit having an op-amp and which alters a phase-difference of the output signal, so that an altered output signal can be formed in-phase or substantially in-phase with the current in the busbar, and the corrector circuit includes a scaling calibration circuit for calibrating and scaling the altered output signal, the scaling calibration circuit including a further op-amp.

17. A low-profile electrical contactor as claimed in claim 1, further comprising an integrated contactor base associated with the electrical contactor, each of the first and second terminals is formed as a stab, the external projection of the stab relative to the integrated contactor base being less than or equal to an internal portion of the stab in volume.

18. A low-profile electrical contactor as claimed in claim 1, wherein the current determining device has a depth which is less than or equal to a depth of the busbar or to a depth of a bridge of the busbar.

19. A method of reducing the depth of an electrical contactor, the method comprising the step of providing a low-profile electrical contactor comprising:

at least one electrical contact switch having
- first and second electrical terminals,
- an electrically-conductive busbar in electrical communication with the first electrical terminal, the busbar having two end faces between which a current can flow in a flow direction and at least two flat sides in parallel with the flow direction,
- at least one fixed electrical contact which is in electrical communication with the busbar,
- an electrically-conductive moveable arm in electrical communication with the second electrical terminal, and
- at least one moveable electrical contact which is in electrical communication with the electrically-conductive moveable arm to form an electrical contact set with the fixed electrical contact;

an actuation means to actuate the electrically-conductive moveable arm of the or each electrical contact switch between open and closed conditions; and a current determining device associated with the busbar, the current determining device having
- a first field-modifying element formed of a magnetic material located at or adjacent to the first flat side of the busbar,
- a second field-modifying element formed of a magnetic material and located at or adjacent to the second flat side of the busbar,
- at least one sensing coil at or adjacent to the busbar and the first and second field-modifying elements, and having a coil axis between planes of the first and second flat sides;
- wherein an electromagnetic field induced by the current flowing in the busbar is modified by the first and second field-modifying elements to extend more or substantially more in parallel with the coil axis of the or each sensing coil, whereby an induced-EMF at the or each sensing coil has improved proportionality with the current flowing in the busbar; and wherein a depth of the current determining device within a housing of the electrical contactor is less than that of the busbar of an electrical contact switch of the electrical contactor.

20. A method as claimed in claim 19, further comprising the step of collocating the current determining device and busbar within the electrical contactor.

* * * * *